US005347666A

United States Patent [19]

Kippes

[11] Patent Number: 5,347,666

[45] Date of Patent: Sep. 20, 1994

[54] TRANSFER AID

[76] Inventor: Arlin J. Kippes, 2800 Maupin La., Topeka, Kans. 66614

[21] Appl. No.: 191,488

[22] Filed: Feb. 4, 1994

[51] Int. Cl.[5] ..... A61G 7/10

[52] U.S. Cl. ..... 5/81.1; 5/662; 135/67

[58] Field of Search ..... 5/81.1, 503.1, 658, 5/662; 297/5; 135/67

[56] References Cited

U.S. PATENT DOCUMENTS

| | | | |
|---|---|---|---|
| 3,176,322 | 4/1965 | Mulcahy | 5/503.1 |
| 3,553,746 | 1/1971 | Seiger | 5/503.1 |
| 3,591,874 | 6/1971 | O'Kennedy | 5/503.1 X |
| 3,668,723 | 6/1972 | Bratton | 5/662 |
| 4,140,301 | 2/1978 | Battiston, Sr. et al. | 135/74 X |
| 4,251,105 | 2/1981 | Barker | 135/67 X |
| 4,922,560 | 5/1990 | Skibinski . | |
| 4,964,182 | 10/1990 | Schmerler . | |
| 5,188,139 | 2/1993 | Garelick | 135/74 X |
| 5,226,439 | 7/1993 | O'Keeffe et al. . | |
| 5,257,425 | 11/1993 | Shinabarger | 5/81.1 |
| 5,275,187 | 1/1994 | Davis | 297/5 X |

FOREIGN PATENT DOCUMENTS 2274274 1/1976 France .

*Primary Examiner*—Michael F. Trettel
*Attorney, Agent, or Firm*—Richard C. Litman

[57] ABSTRACT

The present invention is a transfer aid for assisting people with restricted mobility to rise from a seated position into a standing position. It is a lightweight, portable device having a portion for the user to grasp positioned directly in front of the user. Two supports are each located on either side of the portion to be grasped, and are each rotatable with respect to this portion. This adds flexibility to the device and permits it to be used in a plurality of situations. The transfer aid is easily transported by tilting it so that it rests upon wheels, or tilting it so that it rests upon plastic caps.

13 Claims, 5 Drawing Sheets

FIG. 1
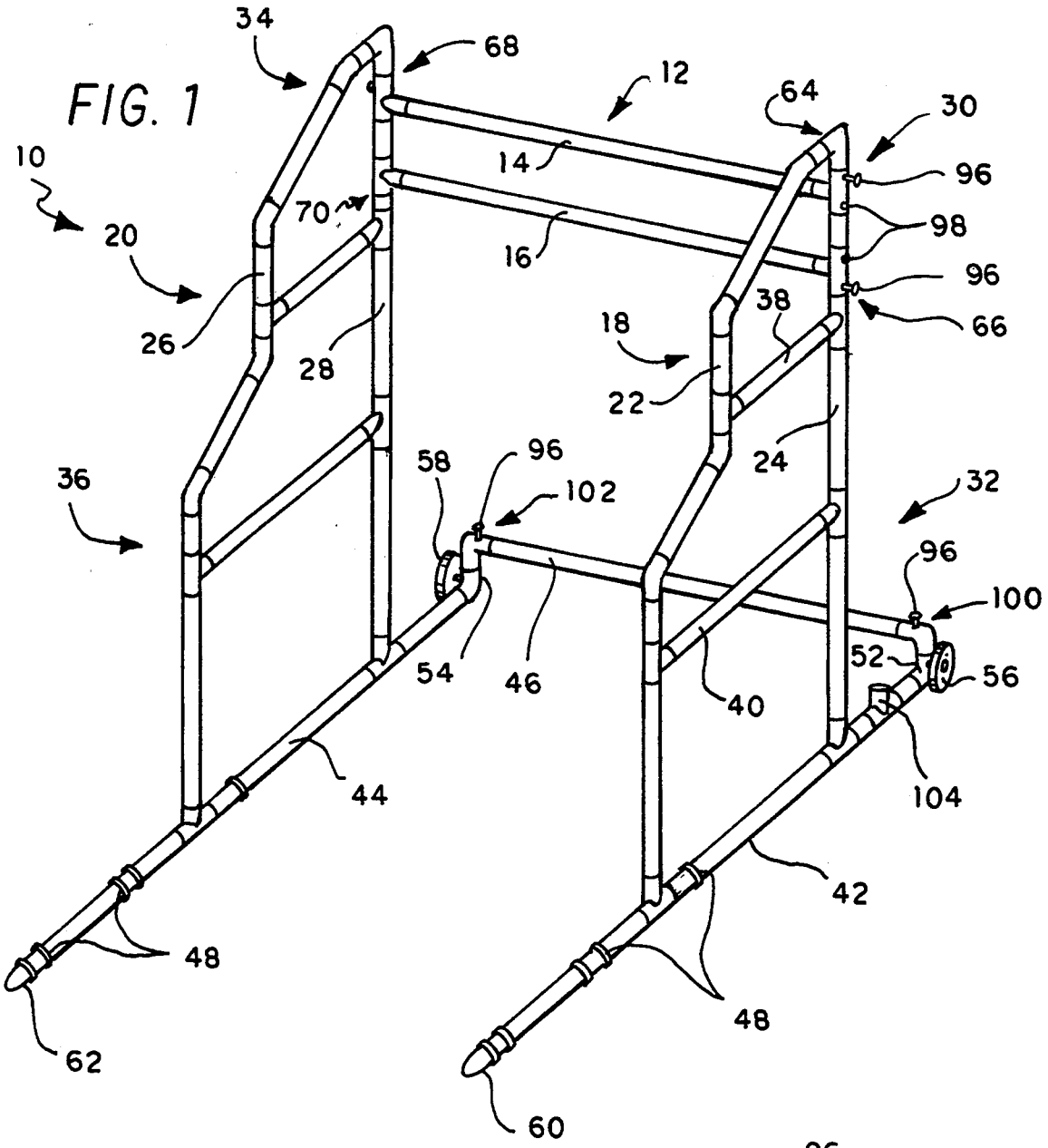
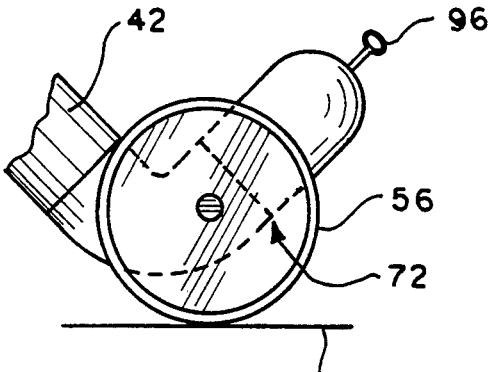
FIG. 3
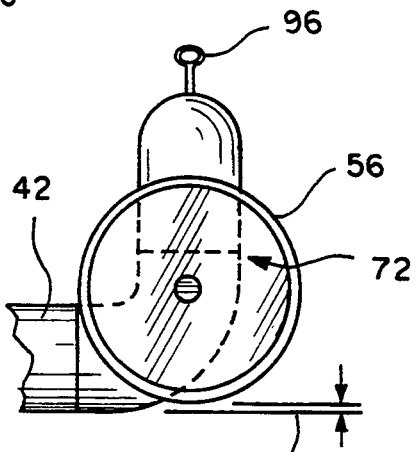
FIG. 2

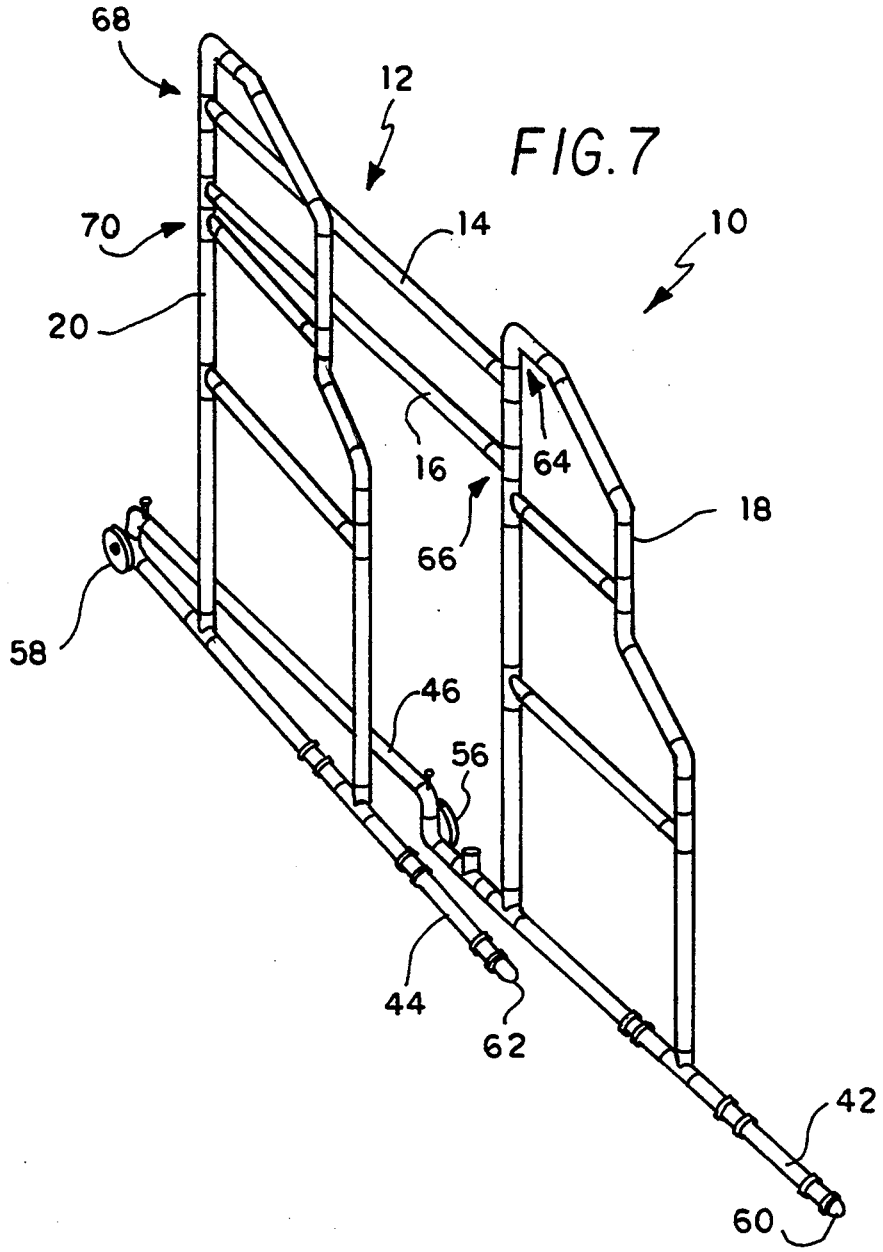
FIG. 7
FIG. 8A
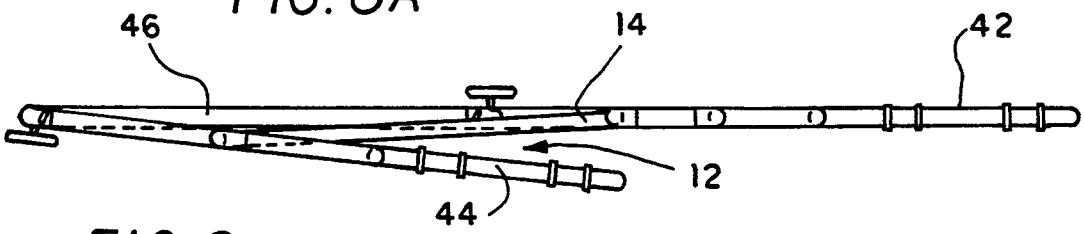
FIG. 8B
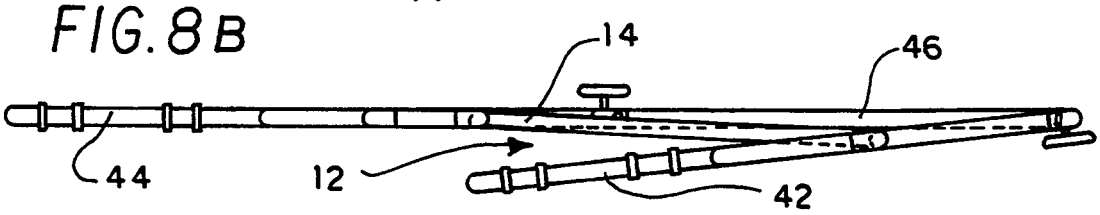

FIG. 9
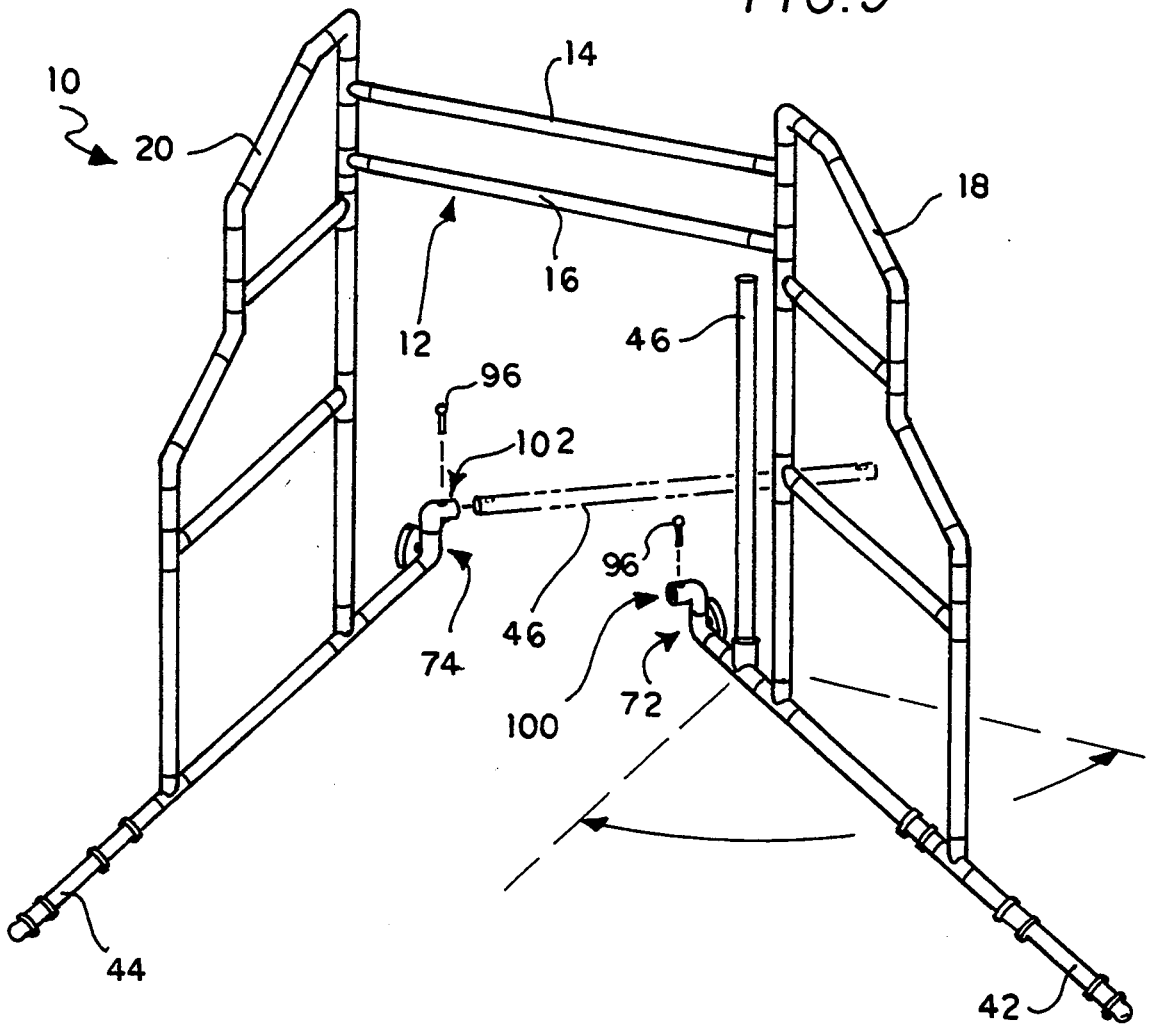
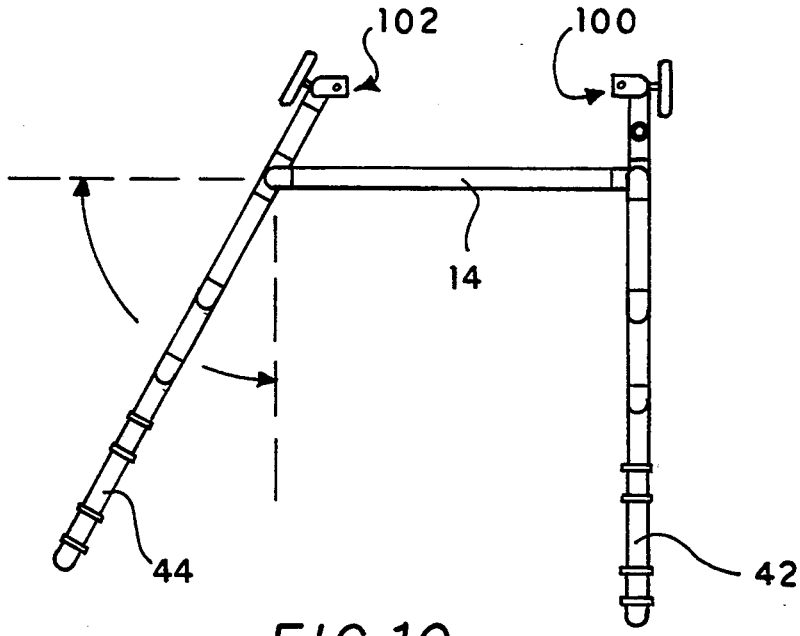
FIG. 10

TRANSFER AID

BACKGROUND OF THE INVENTION

1. Field of the Invention

The present invention relates to a transfer aid designed for assisting a user in rising from a seated position. More particularly, the invention relates to a portable, lightweight transfer aid, capable of being used in conjunction with a standard walker or similar device.

2. Description of the Prior Art

People having a limited mobility often need assistance when rising from a seated position to a standing position. However, helping such a person carry out this activity is commonly too great a task for a single caregiver to undertake. The caregiver may not posses sufficient strength for effective assistance, and if the caretaker does posses such strength, the awkward act of lifting a person of limited mobility may result in injury to either the patient or caregiver, or both.

Devices for assisting persons to raise to a standing position, without the assistance of a caregiver, are known in the prior art. Common to these devices is a supporting mechanism for the user to grasp and exert force against in order to facilitate movement into a standing position. One type of supporting mechanism includes a plurality of support bars positioned in front of the user, where the bars can easily be grasped. This type of mechanism is seen in Joseph Schmerler U.S. Pat. No. 4,964,182, Oct. 23, 1990, which shows a transfer aid for elderly or infirm individuals. Included in this invention is a selectively swingable and extendable center frame having a plurality of assist bars for grasping by the user. This support frame is for positioning in front of the user and is securable in both a substantially vertical and horizontal position, depending upon the needs of the user.

A second type of supporting mechanism includes a pair of support bars for positioning on opposite sides of the user. Here, the user places one hand on each support bar so each arm is in a substantially vertical position. The user pushes downward on the support bar until he or she is in an upright position. Patents showing this type of supporting mechanism are Bernard J. Skibinski U.S. Pat. No. 4,922,560, May 8, 1990, Henry J. O'Keefe et al. U.S. Pat. No. 5,226,439, Jul. 13, 1993, and French Pat. No. 2 274 274 issued on Jan. 9, 1976.

The Skibinski patent discloses a portable assist having two handles attached to a rectangular platform. These handles are for the user to push upon when elevating himself or herself into a standing position. When the device is not being used, the handles may be rotated so as to rest on the platform.

The O'Keefe patent teaches a supporting device for use with standard chairs. The chair rests on a platform from which two vertically adjustable handles extend adjacent to either side of the user. The user pushes upon the handles when moving into an upright position, and the weight of the user and chair prevents the platform from slipping or tipping over. A similar device is shown in the French patent which also discloses two vertically adjustable handles. However, this invention does not include a platform to support the user as he or she rises to an upright position.

None of the above inventions and patents, taken either singly or in combination, is seen to describe the instant invention as claimed.

SUMMARY OF THE INVENTION

This invention is a transfer aid for assisting people with restricted mobility to rise from a seated position into a standing position. It is a lightweight, portable device having a grasping portion for positioning in front of the user. To rise from a seated position, the user clutches and pulls on this grasping portion until he or she is standing upright.

The grasping portion is secured by two supports, one on each side of the grasping portion. Each of these supports is rotatable with respect to the grasping portion, thus allowing the transfer aid to be arranged into a plurality of configurations. This adds flexibility to the transfer aid and therefore allows its use to be tailored to the specific needs of each patient and caregiver. If it is necessary to store the transfer aid or to carry it through a narrow passageway, it can be folded into a small and easily manageable size. Additionally, each support is individually rotatable with respect to the grasping portion. Therefore, each support can be rotated out of the path of the user when walking either to or from the grasping portion of the device. This is especially important when the transfer aid in used in conjunction with a walker or similar device, which is difficult to maneuver in confined areas. Wheels attached to the transfer aid allow it to be easily moved. These wheels are arranged on the transfer aid so as to not contact the floor when the elongated bases are flat on the floor. However, when the transfer aid is tilted, these wheels engage the floor and allow the device to be easily moved.

Accordingly, it is a principal object of the invention to provide a novel transfer aid of a lightweight, sturdy construction.

It is another object of the invention to provide a novel transfer aid capable of being folded for storage or for carrying through a narrow passageway.

It is a further object of the invention to provide a novel transfer aid capable of being arranged into a plurality of configurations.

Still another object of the invention is to provide a novel transfer aid having wheels facilitating easy maneuvering of the transfer aid.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

FIG. 1 is a perspective view of the transfer aid of the present invention.

FIG. 2 is a partial, side, elevational view of a wheel of the transfer aid of FIG. 1, showing the wheel raised above the flooring surface.

FIG. 3 is a partial, side, elevational view of the wheel of FIG. 7 contacting a flooring surface.

FIG. 7 is a perspective view of the transfer aid of FIG. 1 showing the folded position.

FIG. 8A is a top, plan view of the transfer aid of FIG. 1 showing a folded configuration.

FIG. 8B is a top, plan view of the transfer aid of FIG. 1, showing an alternate folded configuration.

FIG. 9 is a perspective view of the transfer aid of FIG. 1 showing an open configuration.

FIG. 10 is a top, plan view of the transfer aid of FIG. 1 showing an alternate open configuration.

Similar reference characters denote corresponding features consistently throughout the attached drawings.

DETAILED DESCRIPTION OF THE PREFERRED EMBODIMENT

Figure 4:
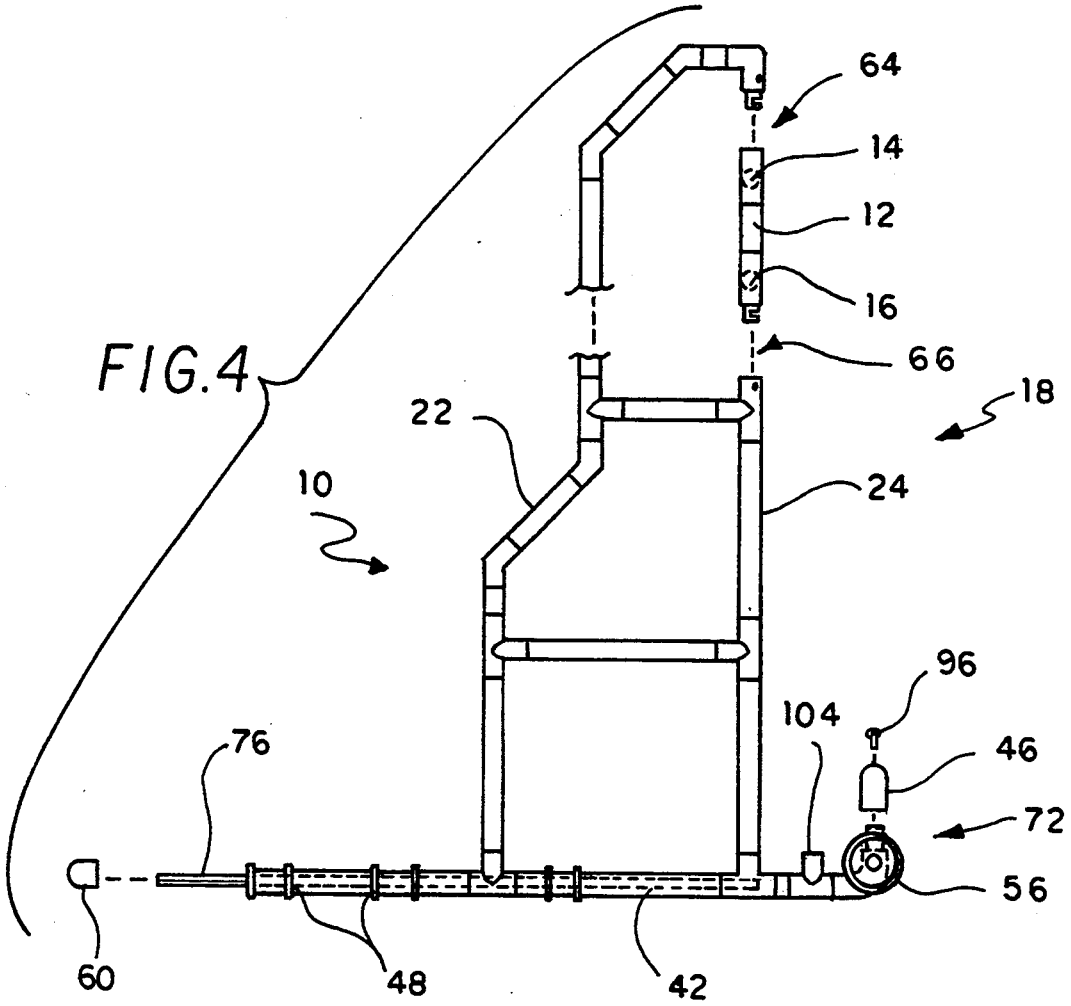
FIG. 4 is a side, elevational view of the transfer aid of FIG. 1.

Referring now to FIG. 1, the present invention is a transfer aid 10 for use by a person having limited mobility when he or she desires to stand from a seated position. This device includes a grasping portion 12 having two shafts 14,16 for the patient to clutch and pull on when rising into a standing position.

These shafts 14,16 are secured by supports 18,20, having sides 22,24 and 26,28, respectively. The distance between sides 22 and is narrower at the top portion 30 of support 18 than it is at the bottom portion 32 of support 18. Correspondingly, the distance between sides 26 and 28 is narrower at the top portion 34 of support 20 than it is at the bottom portion 36 of support 20. The narrow top portions 30,34 allow a caregiver to have uninhibited access to the patient to assist him or her during the standing process. However, the wide bottom portions 32,36 assure stability of each support 18,20. Rods 38,40 secure side 22 to side 24, and rods 42,44 secure side 26 to side 28. These rods 38,40,42 and 44 further increase the stability of transfer aid 10.

Elongated bases 42,44 are attached to supports 18,20, respectively. A portion of each of these elongated bases 42,44 extends outward from each support 18,20 to prevent transfer aid 10 from tipping during use. A stabilizing bar 46 connects elongated base 42 to elongated base 44 to increases the stability of the device 10. Each elongated base 42,44 includes rubber belts 48, secured at various points along the length of each elongated base 42,44, for preventing slippage of transfer aid 10 along the flooring surface 50. Although rubber belts 48 have proven highly effective in eliminating slippage, any other material having a high coefficient of friction could suffice.

Transfer aid 10 may be constructed from PVC schedule 40 plastic tubing and related PVC parts. This plastic is extremely lightweight, thus making device 10 easily transportable from one location to another. To move transfer aid 10, it can be tilted upon the ends of the elongated bases to raise rubber belts 48 away from flooring surface 50. One end 52,54 of each elongated base 42,44 is provided with a wheel 56,58, as shown in FIG. 2. These wheels 56,58 are secured to each elongated base 42,44 so as to be raised above flooring surface 50 when elongated bases 42,44 firmly rest on flooring surface 50. However, when transfer aid 10 is tilted, as depicted in FIG. 3, wheels 56,58 engage flooring surface 50 and permit rolling of transfer aid 10.

An alternative method of moving transfer aid 10 is to tip it upon the ends of the elongated bases opposite each wheel 56,58. As shown in FIG. 1, these ends are provided with a plastic cap 60,62 fabricated from a material having a low coefficient of friction. When transfer aid 10 is tilted so as to rest on these plastic caps 60,62, it is easily pushed to a desired location.

In addition to being easily movable, transfer aid 10 is maneuverable into a plurality of different configurations. This maneuverability results from a variety of rotatable attachments between several parts of the frame and is best illustrated in FIG. 4. As seen in this figure, grasping portion 12 is rotatably secured to top portion 30 of support 18 at locations 64,66. Similar rotatable attachments occur at locations 68,70 which are junction points between grasping portion 12 and top portion 34 (shown in FIG. 1). Additionally, stabilizing bar 46 is rotatably attached to each elongated base 42,44 at locations 72,74. FIG. 4, shows the attachment of stabilizing bar 46 to elongated base 42 at location 72. Also shown in FIG. 4 is rod 76 which fits inside elongated base 42 to increase its strength. A similar rod 76 fits inside elongated base 44 (not shown).

Figure 5:
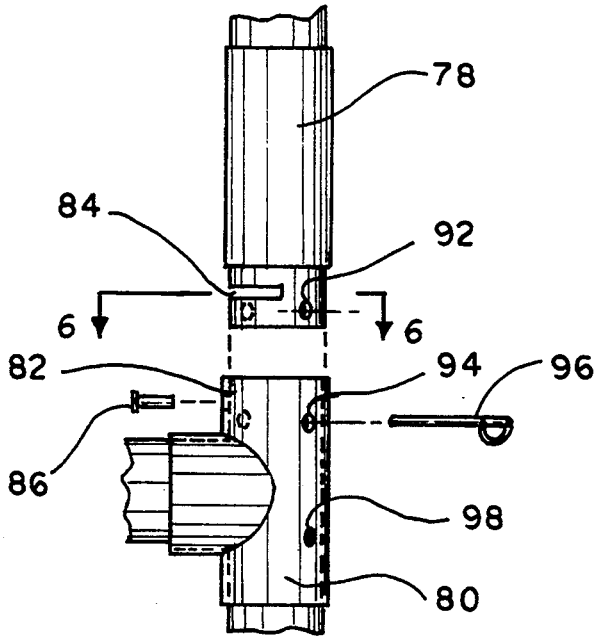
FIG. 5 is a partial, side elevational view of the rotating pipe attachment of the present invention.
Figure 6:
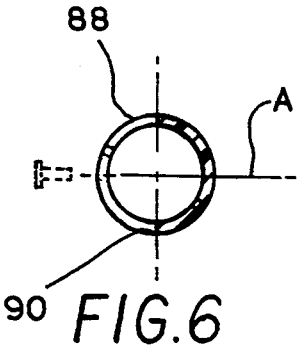
FIG. 6 is a bottom view in cross section of the pipe of FIG. 12.

The mechanics of the rotatable attachments at locations 64,66,68,70,72 and 74 are all identical and are depicted generally in FIG. 5. Although this figure depicts an attachment between a straight pipe 78 and a T-shaped pipe 80, this figure is intended to represent the rotatable attachment between any two pipes, regardless of whether one or both of the pipes are straight, T-shaped, or angled. As shown in the figure, pipe 78 fits telescopically into pipe 80 and bore 82 is alignable with slot 84. As seen in FIG. 6, slot 84 extends 180 degrees around the perimeter of pipe 78. Stud 86, shown in FIG. 5, protrudes through bore 82 and into slot 84 so as to be at the longitudinal center of slot 84 when transfer aid 10 is in the configuration shown in FIG. 1. This is depicted in FIG. 6, where center line A protrudes through the longitudinal center of slot 84. When pipes 78,80 of FIG. 5 are arranged with stud 86 at the longitudinal center of slot 84, pipe 80 is permitted to rotate 90 degrees relative to pipe 78 in either the clockwise direction or the counterclockwise direction when viewed from line 6—6 (FIG. 6). If the rotation is in the clockwise direction, a 90 degree turn of pipe 80 forces stud 86 against point 88 on pipe 78. This contact of stud 86 against point 88 terminates rotation of pipe 80. Correspondingly, after a 90 degree turn in the counterclockwise direction, point 90 impacts stud 86 to terminate rotation of pipe 80.

When transfer aid 10 is in the configuration depicted in FIG. 1, bore 92 in pipe 78 aligns with bore 94 in pipe 80. A pin 96 is inserted into these alignable bores 92,94 to prevent rotation of pipe 80 relative to pipe 78. Pin 96 is easily removed when it is desired to permit the pipes 78,80 to rotate, and pin 96 can be stored in bore 98 when it is not used within alignable bores 92,94. The pins at locations 64,66 prevent rotation of support 18 relative to grabbing portion 12, while the pins at locations 68,70 prevent rotation of support 20 relative to grabbing portion 12.

As best seen in FIG. 1, transfer aid 10 includes two additional pins 96,96, one at location 100 and the other at location 102. These locations 100,102 are not points of rotation, but rather are attachment points of stabilizing bar 46 to each elongated base 42,44. Each of these pins protrudes stabilizing bar into a bore in one of the elongated bases 42,44. When the pins 96,96 at these locations 100,102 are removed, and one of the elongated bases 42 or 44 is slightly rotated away from stabilizing bar 46, the stabilizing bar 46 may be detached from elongated bases 42,44. Opening 104 in elongated base 42 is used to store stabilizing bar 46 after its removal. The importance of removing stabilizing bar 46 will become apparent in the discussion to follow.

It is important to note that each elongated base 42,44 is rotatable with respect to stabilizing bar 46. This rotation occurs at locations 72,74. The pins 96,96 which secure stabilizing bar 46 to elongated bases 42,44 are not utilized to prevent rotation of stabilizing bar 46 relative to elongated bases 42,44. Rotation at locations 72,74 can only occur when there is a corresponding rotation at locations 64,66,68, and 70. Therefore, when the pins 96,96,96,96 prevent rotation at locations 64,66,68,70, there can be no rotation at points 72,74.

One of the plurality of configurations of transfer aid 10 is depicted in FIGS. 7, 8A and 8B, and is referred to hereafter as the folded position. This position is beneficial for storing transfer aid 10 or when transporting it through a confined area, such as a doorway. To collapse transfer aid 10 into this folded position, elongated bases 42,44 must be free to rotate relative to stabilizing bar 46. Therefore, as previously mentioned, pins 96 must be removed from locations 64,66,68,70, thus permitting rotation at locations 64,66,68,70,72,74. After the pins 96 have been removed, transfer aid 10 can be placed into its folded position by simultaneously rotating elongated bases 42,44 relative to stabilizing bar 46, as shown in FIGS. 7, 8A and 8B. The folded position of FIG. 7 is achieved by rotating elongated bases 42,44 in the counterclockwise direction, when viewed from above. In FIG. 8A, the folded position is achieved by rotating elongated bases 42,44 in the counterclockwise direction. FIG. 8B shows the folded position after elongated bases 42,44 are rotated in the clockwise direction.

Another configuration of transfer aid 10 is shown in FIGS. 9 and 10, and is referred to hereafter as the open position. In order to move transfer aid 10 into this position, stabilizing bar 46 must be removed by withdrawing pins 96,96 at locations 100,102, and slightly rotating one of the elongated bases 42 or 44, as described above. After removal of stabilizing bar 46, each elongated base 42,44, along with its attached support 18,20, is rotatable with respect to grasping portion 12. Hence, if pins 96,96 are removed from locations 64,66, support 18 can be rotated, and if pins 96,96 are removed from locations 68,70, support 20 can be rotated. In the perspective view shown in FIG. 9, pins 96,96 have been removed from locations 64,66 and support 18 has been rotated from its position depicted in FIG. 1. Stabilizing bar 46, as it attaches to each elongated base 42,44, is shown in phantom lines. The stabilizing bar 46 is also shown in solid lines to be stored within opening 104. In the top plan view shown in FIG. 10, pins 96,96 have been removed from locations 68,70 and support 20 has been rotated from its position shown in FIG. 1.

That each support 18,20 and its attached elongated base 42,44 can rotate relative to grasping portion 12 adds great flexibility to transfer aid 10. First, the structure allows transfer aid 10 to be used in almost any room, regardless of its size and shape constraints. If a room does not posses sufficient space for elongated bases 42,44 to be arranged in the configuration shown in FIG. 1, each elongated base 42,44 could be angled as necessary to fit within the given constraints. Second, each elongated base 42 or 44 can be rotated away from the path through which the user must walk to either enter or exit from the confines of transfer aid 10. This is extremely valuable to people having limited mobility as even the slightest hinderance can become a substantial obstacle to overcome. Additionally, when transfer aid 10 is used in conjunction with a walker 106, as later described in greater detail, it is important that the user have a clear passageway to and from the machine 10.

In addition to being used in the open position, transfer aid 10, as mentioned, could be utilized in the configuration depicted in FIG. 1. In fact, it is envisioned that this configuration will be utilized most often and therefore is the topic of the following discussion detailing a typical use of transfer aid 10.

Figure 11:
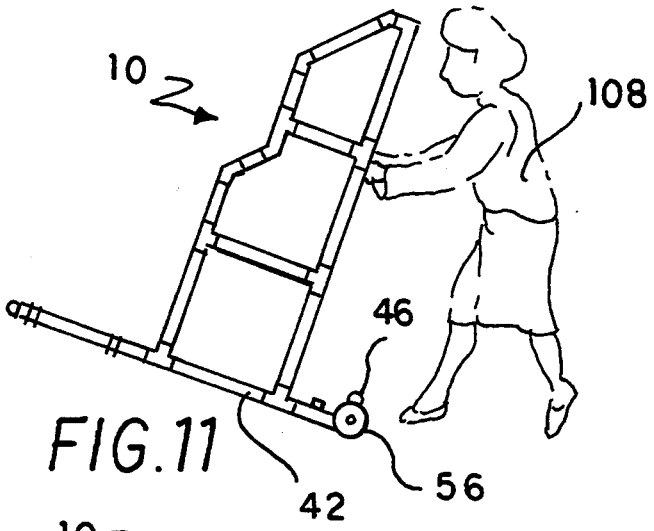
FIG. 11 is an environmental, side, elevational view showing the transfer aid of FIG. 1 being rolled.
Figure 12:
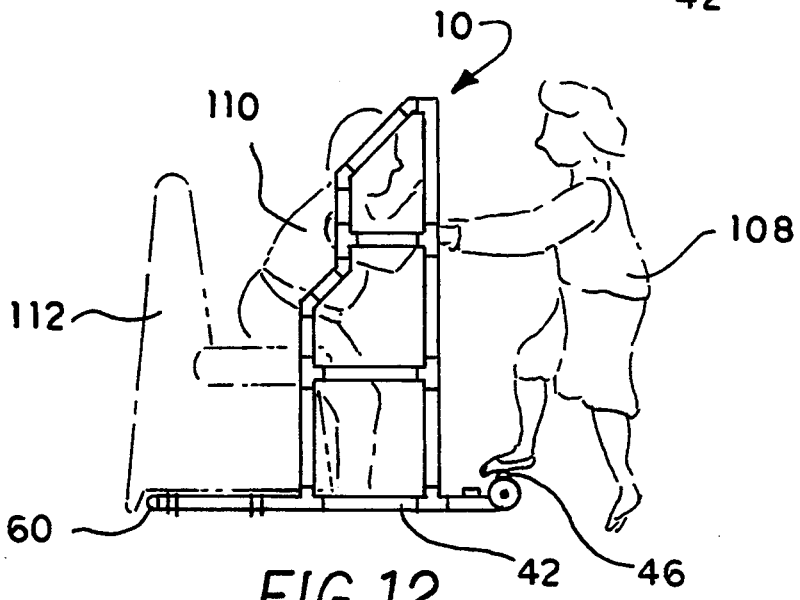
FIG. 12 is an environmental, side, elevational view showing the transfer aid of FIG. 1 in use.

As shown in FIG. 11, a caregiver 108 can easily transport transfer aid 10 upon its wheels 56,58, as described above. The caregiver 108 places the grasping portion 12 in front of a seated patient 110, as illustrated in FIG. 12. If the chair or other apparatus 112 upon which the patient 110 is sitting permits, a portion of each elongated base 42,44 could be secured under the chair 112. Transfer aid 10 can be moved into this position by slightly tipping it to rest upon plastic caps 60,62. Once tipped to this position, a portion of elongated bases 42,44 can be pushed under chair 112, thus adding stability to transfer aid 10. If, on the other hand, chair 112 upon which the patient is sitting is not configured to permit a portion of the elongated bases 42,44 to be placed thereunder, chair 112 could be placed between elongated bases 42,44. Additionally, it is emphasized that transfer aid 10 can be utilized with a stool, bed, recliner, or any other device upon which a person may sit.

Figure 13:
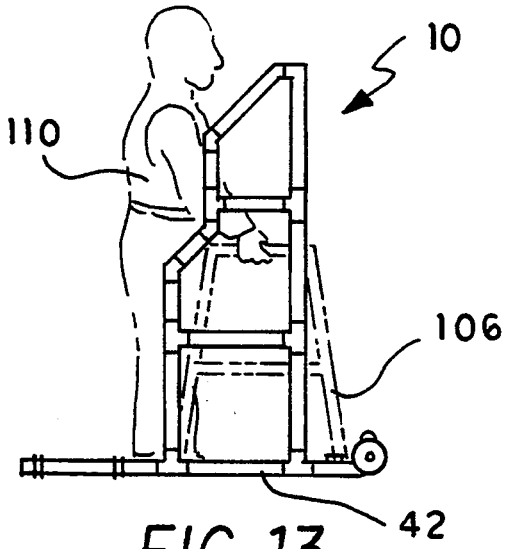
FIG. 13 is an environmental, side, elevational view showing the transfer aid of FIG. 1 used in conjunction with a walker.

When attempting to rise, patient 110 clutches grasping portion 12 and pulls on this portion 12 to lift his or her body into an upright position. As patient 110 pulls on grasping portion 12, caregiver 108 can be in one of two locations. In the first location, caregiver 108 stands with one foot on stabilizing bar 46, as depicted in FIG. 12. This prevents tippage of transfer device 10. The second position of caregiver 108 is slightly to the side of patient 110, where caregiver 108 can physically help patient 110 raise (not shown). When in this position, caregiver 108 can place one foot on the elongated base 42 or 44 directly in front of them. This maintains stability of aid 10. If transfer aid 10 were being used in the open position, where stabilizing bar 46 is removed, this second position is where caregiver 108 would stand. Once patient 110 is upright, caregiver 108 can place patient's walker 106, if utilized, directly in front of patient 110, as depicted in FIG. 13. The transition of patient 110 from transfer aid 10 to walking device 106 is smooth and easy as patient 110 need only transfer his or her hands from grasping portion 12 to walker 106. Caregiver 108 can then remove transfer aid 10 from in front of patient 110 by tilting it upon plastic caps 60,62 and sliding it along the flooring surface 50. Alternatively, caregiver 108 can leave transfer aid 10 in front of the patient, and clear a path for patient 110 to walk away from the aid 10. This is accomplished by rotating one of the elongated bases 42 or 44 relative to grasping portion 12, as described above.

The above discussion detailing a common use of transfer aid 10 is only one typical use of transfer aid 10. The flexibility of the device 10, however, allows it to be utilized in a plurality configurations, and therefore transfer aid 10 can satisfy the needs of almost any patient and caregiver. This transfer aid 10 is for use by both the patient and the caregiver and encourages independence as well as a sense of participation.

It is to be understood that the present invention is not limited to the sole embodiment described above, but encompasses any and all embodiments within the scope of the following claims.

I claim:

1. A transfer aid comprising:

an elongated base having an underside for contacting a flooring surface;

a pair of substantially identical, vertically oriented supports extended upwardly from said base;

grasping means comprising at least one shaft extended between said supports, and serving as a hand hold for a user to raise oneself from a seated position; and means pivotally interconnecting said grasping means and at least one of said supports, whereby said at least one of said supports may be swung outwardly and away from said grasping means;

said base extending forwardly and rearwardly of said supports, thus to provide a secure, non-tiltable base for said transfer aid when in use.

2. The transfer aid according to claim 1 wherein each of said supports is provided with means pivotally interconnecting said grasping means therewith.

3. The transfer aid according to claim i wherein said grasping means comprise a pair of generally parallel shafts, pivotally interconnected to said supports.

4. The transfer aid according to claim 1, further comprising means for selectively rigidly interengaging said grasping means with said supports.

5. The transfer aid according to claim 4, further comprising means for selectively rigidly interengaging said grasping means with said supports.

6. The transfer aid according to claim 1, at least the undersurface of said base means further including material having a high coefficient of friction for stabilizing said transfer aid when in use.

7. The transfer aid according to claim 1, said elongated base further including low coefficient of friction means on at least one end thereof, whereby said transfer aid may be moved easily over a flooring surface by tilting said transfer aid so that said low coefficient of friction means is in contact with a flooring surface.

8. The transfer aid according to claim 1, said base means further including wheel means mounted on an end thereof, said wheel means being out of contact with a flooring surface when said elongated base is positioned on said flooring surface, said wheel means supporting said elongated base when said transfer aid is tilted, whereby said transfer aid may be easily moved over a flooring surface.

9. The transfer aid according to claim 1, further comprising a stabilizing bar located beneath said grasping means and rotatably attached to said elongated base.

10. The transfer aid according to claim 9, wherein said stabilizing bar is removably secured to said elongated base, there further being storage means on said base for receiving said stabilizing bar when removed from said base.

11. A transfer aid comprising:

a grasping portion;

two supports each positioned on an opposite side of said grasping portion, each of said two supports having a top portion rotatably attached to said grasping portion;

two elongated bases attached to bottom portions of said two supports, each of said elongated bases having an underside for contacting a flooring surface;

two wheels, one attached to each of said two elongated bases, each of said two wheels being out of contact with the flooring surface when said underside of each of said two elongated bases is in contact with the flooring surface; and a stabilizing bar rotatably and removably attached to each of said two elongated bases.

12. The transfer aid according to claim 11, wherein at least one portion of said underside of each of said two elongated bases is fabricated from a material having a high coefficient of friction.

13. The transfer aid according to claim 11, wherein each of said two elongated bases further comprises a first end fabricated from a material having a low coefficient of friction.

* * * * *